US009988595B2

(12) United States Patent
Brandt-Sanz et al.

(10) Patent No.: US 9,988,595 B2
(45) Date of Patent: Jun. 5, 2018

(54) WATER SOLUBLE UNIT DOSE ARTICLE COMPRISING AN AVERSIVE AGENT

(71) Applicant: The Procter & Gamble Company, Cincinnati, OH (US)

(72) Inventors: Miguel Brandt-Sanz, Tervuren (BE); Florence Catherine Courchay, Brussels (BE); David Xavante Cumming, Brussels (BE); Regine Labeque, Neder-over-Heembeek (BE); Philip Frank Souter, Northumberland (GB)

(73) Assignee: The Procter & Gamble Company, Cincinnati, OH (US)

( * ) Notice: Subject to any disclaimer, the term of this patent is extended or adjusted under 35 U.S.C. 154(b) by 157 days.

(21) Appl. No.: 15/252,256

(22) Filed: Aug. 31, 2016

(65) Prior Publication Data

US 2017/0066999 A1 Mar. 9, 2017

(30) Foreign Application Priority Data

Sep. 4, 2015 (EP) ..... 15183838

(51) Int. Cl.

| | |
|---|---|
| ***C11D 17/04*** | (2006.01) |
| ***C11D 1/83*** | (2006.01) |
| ***C11D 3/37*** | (2006.01) |
| ***C11D 11/00*** | (2006.01) |
| ***C11D 3/22*** | (2006.01) |

(Continued)

(52) U.S. Cl.

CPC ..... *C11D 17/042* (2013.01); *C11D 1/83* (2013.01); *C11D 3/222* (2013.01); *C11D 3/32* (2013.01); *C11D 3/3753* (2013.01); *C11D 11/0017* (2013.01); *C11D 11/0023* (2013.01); *C11D 17/0039* (2013.01); *C11D 17/045* (2013.01)

(58) Field of Classification Search

CPC ... C11D 17/042; C11D 17/043; C11D 17/044; C11D 17/045; C11D 1/83; C11D 3/3753; C11D 11/0017; C11D 11/0023; B65D 65/46; B65D 81/3266

USPC ..... 510/296, 438, 439

See application file for complete search history.

(56) References Cited

U.S. PATENT DOCUMENTS

| | | | |
|---|---|---|---|
| 5,783,541 | A | 7/1998 | Tack et al. |
| 9,150,782 | B2 | 10/2015 | Lee et al. |
| 2003/0100461 | A1 | 5/2003 | Catlin et al. |

(Continued)

FOREIGN PATENT DOCUMENTS

| | | | |
|---|---|---|---|
| CA | 2 892 827 | A1 | 8/2015 |
| CA | 2 903 528 | A1 | 11/2015 |

(Continued)

OTHER PUBLICATIONS

EP Search Report for Application No. 15183838.0-1358, dated Feb. 17, 2016, 5 pgs.

(Continued)

*Primary Examiner* — Lorna M Douyon

(74) *Attorney, Agent, or Firm* — Melissa Krasovec; Leonard W. Lewis; Steven W. Miller

(57) ABSTRACT

Water soluble unit dose article comprising detergent or cleaning composition, a water-soluble film surrounding the composition and a particle comprising an aversive agent coated onto the outer surface of the water soluble film, and a process for making the water soluble unit dose article.

20 Claims, 1 Drawing Sheet

(51) Int. Cl.
*C11D 3/32* (2006.01)
*C11D 17/00* (2006.01)

(56) References Cited

U.S. PATENT DOCUMENTS

| | | | | |
|---|---|---|---|---|
| 2014/0371411 | A1 | 12/2014 | DiPietro et al. | |
| 2015/0158645 | A1 | 6/2015 | Meier et al. | |
| 2015/0158646 | A1 | 6/2015 | Meier et al. | |
| 2015/0252304 | A1 | 9/2015 | Souter et al. | |
| 2015/0252305 | A1* | 9/2015 | Souter | C11D 3/32 510/406 |
| 2015/0252306 | A1* | 9/2015 | Souter | C11D 3/32 510/406 |
| 2016/0102278 | A1* | 4/2016 | Labeque | C11D 17/042 510/296 |
| 2016/0102279 | A1* | 4/2016 | Labeque | C11D 17/042 510/296 |
| 2016/0258083 | A1 | 9/2016 | Weisman et al. | |

FOREIGN PATENT DOCUMENTS

| | | | |
|---|---|---|---|
| CA | 2 903 529 | A1 | 11/2015 |
| DE | 102013218614 | | 3/2015 |
| EP | 1 375 377 | A1 | 1/2004 |
| EP | 1 436 376 | B1 | 4/2010 |
| WO | WO 99/67154 | | 12/1999 |
| WO | WO 2014127975 | | 8/2014 |
| WO | WO 2015/091110 | | 6/2015 |

OTHER PUBLICATIONS

EP Search Report for Application No. 15183840.6-1358, dated Mar. 1, 2016, 6 pgs.
EP Search Report for Application No. 15183841.4-1358, dated Mar. 1, 2016, 6 pgs.
EP Search Report for Application No. 15183842.2-1358, dated Mar. 1, 2016, 6 pgs.
EP Search Report for Application No. 15183844.8-1358, dated Mar. 1, 2016, 6 pgs.
EP Search Report for Application No. 15183851.3-1358, dated Mar. 1, 2016, 7 pgs.
Behrens M et al: "Signaling in the Chemosensory Systems; Bitter taste receptors and human bitter taste perception", CMLS Cellular and Molecular Life Sciences, Birkhauser-Verlag, BA, vol. 63, No. 13,May 29, 2006 (May 29, 2006), pp. 1501-1509, XP019419216, ISSN: 1420-9071, 001: 10.1007/S00018-006-6113-8.
Xiaoxia Wang, Stephanie D. Thomas and Jianzhi Zhang, Relaxation of selective constraint and loss of function in the evolution of human bitter taste receptor genes, Human Molecular Genetics, 2004, vol. 13, No. 21 2671-2678 Advance Access published on Sep. 14, 2004.
Ayana Wiener, Marina Shudler, Anat Levit and Masha Y. Niv, BitterDB: a database of bitter compounds; Nucleic Acids Research, 2012, vol. 40, pp. D413-D419; Published online Sep. 22, 2011.
David A. Stevens, Individual differences in taste perception; Food Chemistry, vol. 56, No. 3. pp. 303-311, 1996.
U.S. Appl. No. 15/252,263, filed Aug. 31, 2016, Miguel Brandt Sanz, et al.
U.S. Appl. No. 15/252,270, filed Aug. 31, 2016, Regine Labeque, et al.
U.S. Appl. No. 15/252,271, filed Aug. 31, 2016, Philip Frank Souter, et al.
U.S. Appl. No. 15/252,277, filed Aug. 31, 2016, Philip Frank Souter, et al.
U.S. Appl. No. 15/252,281, filed Aug. 31, 2016, David Xavante Cumming, et al.

* cited by examiner

WATER SOLUBLE UNIT DOSE ARTICLE COMPRISING AN AVERSIVE AGENT

FIELD OF THE INVENTION

The present invention relates to water soluble unit dose articles coated with aversive agent, methods of their manufacture and methods of their use.

BACKGROUND OF THE INVENTION

Water-soluble unit dose articles are preferred by consumers as they offer effective and efficient means of dosing appropriate levels of detergent or cleaning compositions to the wash. However, water-soluble unit dose articles come in the form of small pouches containing concentrated detergent or cleaning compositions.

Aversive agents can be added to water-soluble unit dose article to reduce likelihood of accidental ingestion. Such aversive agents could be substance that provide a bitter taste to the unit dose article and so elicit an instinctive impulse to spit the unit dose article out of the mouth.

One method of providing the unit dose article with an aversive agent is to formulate it within the water-soluble film itself. However, such a method introduces manufacturing complexity as the aversive agent has to be formulated into the film without affecting film dissolution or general stability.

Therefore, it is preferred to add the aversive agent in such a way that minimises effect on film stability and dissolution profiles and also minimises manufacturing complexity. Furthermore, there is a need to add the aversive agent in such a way that if the unit dose article is accidentally ingested, the aversive agent can effectively motivate the user to spit it out, and such effective motivation should be provided over the lifetime of the unit dose article (e.g. after a period of storage). A final requirement is that the aversive agent be present at a concentration effective to provide the motivation to spit it out whilst also avoiding formulating excessive unneeded aversive agent which is wasteful and costly.

It was surprisingly found that the unit dose article of the present invention and methods of making said unit dose article overcame these problems.

SUMMARY OF THE INVENTION

A first aspect of the present invention is a water-soluble unit dose article comprising a detergent or cleaning composition, a water-soluble film, and a particle, wherein the water-soluble film has an outer surface and wherein the particle is coated onto the outer surface of the water-soluble film, and wherein the particle comprises an aversive agent, and wherein the water-soluble unit dose article comprises between 5 $mg/m^2$ and 500 $mg/m^2$ of the film outer surface of the particle.

A second aspect of the present invention is a process for making a water-soluble unit dose article according to any preceding claims comprising the steps of;

a. Preparing a water-soluble unit dose article;
b. Adding a particle comprising an aversive agent to the unit dose article wherein the particle is applied by dusting, spraying, printing, electrostatic transfer and mixtures thereof.

A third aspect is a process for making a water-soluble unit dose article according to any preceding claims comprising the steps of;

a. Adding a particle comprising an aversive agent to a water-soluble film wherein the particle is applied by dusting, spraying, printing, electrostatic transfer and mixtures thereof;
b. Preparing a water-soluble unit dose article comprising the film of part a.

DETAILED DESCRIPTION OF THE INVENTION

Water-Soluble Unit Dose Article

Figure 1:
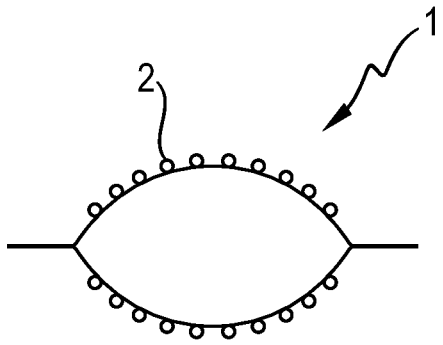
FIG. 1 shows a side-profile picture of a unit dose article comprising a particle on the outer surface wherein the particle comprises an aversive agent. The particle is distributed homogenously over the surface of the unit dose article.

The present invention is to a water-soluble unit dose article comprising a detergent or cleaning composition, a water-soluble film, and a particle, wherein the water-soluble film has an outer surface and wherein the particle is coated onto the outer surface of the water-soluble film, and wherein the particle comprises an aversive agent, and wherein the water-soluble unit dose article comprises 5 $mg/m^2$ and 500 $mg/m^2$ of the film outer surface of the particle.

The aversive agent may be detected on the outer surface of the film using the following test method; the aversive agent is extracted by depositing the film in a glass vial and adding a solution of methanol containing 0.5% TFA (trifluoro acetic acid). Sonication (ultrasonic bath) or stirring is used for the extraction, for a period of time which may depend on the thickness of the sample. The remaining extract is then analyzed by HPLC (High Performance Liquid Chromatography). Quantitative analysis is done by UV detection with a Photo Diode Array detector. Aversive agents can be assayed via standard methods known to those skilled in the art. Analytical techniques may include chromatography or spectroscopic techniques known to one skilled in the art. For example, suitable methods are disclosed in Falkner et al., Journal of Chromatography A. 715 (1995) 189-194, and in R. Bucci et al., Talanta 68 (2006) 781-790.

The water-soluble unit dose article comprises at least one water-soluble film shaped such that the unit-dose article comprises at least one internal compartment surrounded by the water-soluble film. The at least one compartment comprises the detergent or cleaning composition. The water-soluble film is sealed such that the detergent or cleaning composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the composition according to the present invention may be comprised in at least one of the compartments. It may for example be comprised in just one compartment, or may be comprised in two compartments, or even in three compartments.

Each compartment may comprise the same or different compositions. The different compositions could all be in the same form, for example they may all be liquid, or they may be in different forms, for example one or more may be liquid and one or more may be solid.

The detergent or cleaning composition may be present in one compartment or may be present in more than one compartment.

The water-soluble unit dose article comprises a detergent or cleaning composition. Detergent or cleaning compositions are described in more detail below.

The water-soluble unit dose article comprises a water-soluble film. Water-soluble films are described in more detail below.

The water-soluble unit dose article may comprise between 20 $mg/m^2$ and 200 $mg/m^2$ of the film outer surface of the particle. The particle is described in more detail below.

The water-soluble unit dose article may further comprise aversive agent within the water-soluble film. The aversive agent within the water-soluble film and the aversive agent coated onto the unit dose article maybe the same aversive agent or may be different.

The water-soluble unit dose article may comprise an air bubble.

The water-soluble unit dose article may be transparent, translucent or opaque.

Preferably, at least 5%, or even at least 10%, or even at least 20%, or even at least 30% of the aversive agent is lost from the unit dose article with 20 seconds following contact of the unit dose article with an artificial saliva solution. Those skilled in the art will know how to formulate an artificial saliva solution or know where to source one commercially.

Particle

The water-soluble film has an outer surface and the particle is coated onto the outer surface of the water-soluble film. The particle comprises an aversive agent; the aversive agent is described in more detail below.

By 'coated' we herein mean the aversive agent is located on the outer surface of the unit dose article. In other words it is present as a 'layer' covering at least part of the unit dose article.

The particle may comprise between 10% and 90%, preferably between 20% and 85%, more preferably between 30% and 80% by weight of the particle of the aversive agent.

Preferably the particle has an average particle size diameter of between 10 microns and 500 microns.

The particle may comprise a carrier material and the aversive agent, be an encapsulate wherein the encapsulate comprises a shell and a core, or a mixture thereof.

Wherein the particle comprises a carrier and the aversive agent, carrier is preferably selected from the group comprising carbonate, sulphate, zeolite, talc, clay, saccharides, polysaccharides or mixtures thereof. Preferably, the carrier comprises polysaccharide, more preferably the carrier is selected from maltodextrin, cellulose or a mixture thereof.

The carrier may form a matrix into which the aversive agent is absorbed. Alternatively, the aversive agent may be coated onto the carrier. Alternatively, the carrier may form a matrix into which the aversive agent is absorbed and the aversive agent is coated onto the carrier after which it absorbs into the matrix. For example, the aversive agent may be coated onto the carrier and then at least part of the aversive agent is absorbed into the carrier.

The particle may be a spray-dry particle, an agglomerate, an extrudate or a mixture thereof.

Wherein the particle is in the form of an encapsulate, the encapsulate is preferably a core and shell encapsulate and the aversive agent is within the core. The shell may comprise polyvinyl alcohol, melamine formaldehyde, polylactide, polyglycolide, gelatin, polylactide, shellac, zein, chitosan, wax, hydrogenated vegetable oil, polysaccharides paraffin and mixtures thereof.

The shell may comprise a polylactide-polyglycolide copolymer. The shell may comprise a hydrogenated castor oil.

The particles may be arranged in one or more discrete regions on the outer surface of the film or may be homogenously distributed across the whole outer surface of the film. For example the outer surface may comprise regions comprising the particle and regions purposively devoid of the particle. By homogenously distributed we mean that the particle is distributed across the entire surface but the homogenous distribution may result in regions of higher concentration than others. However, homogenously distributed means that no area of the outer surface of the film has intentionally been left devoid of aversive agent.

Aversive Agent

As used herein, an aversive agent is an agent that is intended to discourage ingestion and/or consumption of the unit dose articles described herein or components thereof, such as water-soluble films. An aversive agent may act by providing an unpleasant sensation, such as an unpleasant taste, when placed in the mouth or ingested. Such unpleasant sensations may include bitterness, pungency (or heat/spiciness), an unpleasant odor, sourness, coldness, and combinations thereof. An aversive agent may also act by causing humans and/or animals to vomit, for example via emetic agents. Suitable aversive agents include bittering agents, pungent agents, emetic agents, and mixtures thereof.

The level of aversive agent used may be at least at an effective level, which causes the desired aversive effect, and may depend on the characteristics of the specific aversive agents, for example bitter value. The level used may also be at or below such a level that does not cause undesired transfer of the aversive agents to a human and/or animal, such as transfer to hands, eyes, skin, or other body parts. The amount present may be based on the particular aversive agent's potency such that greater than 50% of humans experience an aversive effect when exposed to the given amount of the aversive agent. The aversive agent may be present at a concentration which elicits repulsive behavior within a maximum time of six seconds in cases of oral exposure.

The aversive agent may be selected from the group comprising naringin; sucrose octaacetate; denatonium benzoate; capsicinoids (including capsaicin); vanillyl ethyl ether; vanillyl propyl ether; vanillyl butyl ether; vanillin propylene; glycol acetal; ethylvanillin propylene glycol acetal; gingerol; 4-(1-menthoxymethyl)-2-(3'-methoxy-4'-hydroxy-phenyl)-1,3-dioxolane; pepper oil; pepperoleoresin; gingeroleoresin; nonylic acid vanillylamide; jamboo oleoresin; *Zanthoxylum piperitum* peel extract; sanshool; sanshoamide; black pepper extract; chavicine; piperine; spilanthol; and mixtures thereof. Other suitable aversive agents are described in more detail below.

Non-limiting examples of suitable bittering agents include denatonium salts and derivatives thereof. The bittering agent may be a denatonium salt selected from the group consisting of denatonium chloride, denatonium citrate, denatonium saccharide, denatonium carbonate, denatonium acetate, denatonium benzoate, and mixtures thereof. The bittering agent may be denatonium benzoate, also known as phenylmethyl-[2-[(2,6-dimethylphenyl)amino]-2-oxoethyl]-diethylammonium benzoate, CAS no. 3734-33-6. Denatonium benzoate is commercially sold as BITREX®, available from Macfarlan Smith, Edinburgh, Scotland, UK.

The bittering agent may be a natural bitter substance. The natural bitter substance may be selected from the group consisting of glycosides, isoprenoids, alkaloids, amino acids, and mixtures thereof. For example, suitable bittering agents also include Quercetin (3,3',4',5,7-pentahydroxyflavone); Naringin (4',5,7-Trihydroxyflavanone-7-rhamnoglucoside); Aucubin; Amarogentin; Dihydrofoliamentin; Gentiopicroside; Gentiopicrin; Swertiamarin; Swerosid; Gentioflavosid; Centaurosid; Methiafolin; Harpagoside; Centapikrin; Sailicin; Kondurangin; Absinthin; Artabsin; Cnicin; Lactucin; Lactucopicrin; Salonitenolid; α-thujone; β-thujone; Desoxy Limonene; Limonin; Ichangin; iso-Obacunoic Acid; Obacunone; Obacunoic Acid; Nomilin; Ichangin; Nomilinoic acid; Marrubin; Pramarrubin; Carnosol; Carnosic acid; Quassin; Brucine; Quinine hydrochloride; Quinine sulfate; Quinine dihydrochloride; Columbine; Caffeine; Threonine; Methionine; Phenylalanine; Tryptophan; Arginine; Histidine; Valine; Aspartic acid; Sucrose octaacetate; and mixtures thereof. Other suitable bittering agents include quinine bisulfate and hop extract (e.g., humulone).

Other non-limiting examples of suitable bittering agents for use as described herein are described at BitterDB (http://bitterdb.agri.huji.ac.il/dbbitter.php), which is a free searchable database of bittering agents that holds over 680 bittering agents obtained from literature and the Merck Index and their associated 25 human bitter taste receptors (hT2Rs), and in the corresponding paper Ayana Wiener; Marina Shudler; Anat Levit; Masha Y. Niv. BitterDB: a database of bitter compounds. *Nucleic Acids Res* 2012, 40(*Database issue*): D413-419.

The bittering agent may exhibit a bitter value of greater than 1,000, or greater than 5,000, or greater than 10,000, or greater than 20,000, and/or less than 10,000,000, or less than 5,000,000, or less than 1,000,000, or less than 500,000, or less than 200,000, or less than 150,000, or less than 100,000. The bittering agent may exhibit a bitter value of from about 1,000 to about 10,000,000, or from about 5,000 to about 1,000,000, or from about 10,000 to about 200,000. The bitter value is measured using the standardized process set forth in the European Pharmacopoeia (5th Edition, Stuttgart 2005, Volume 1, General Monograph Groups, 2.8.15 Bitterness Value, p. 278).

The aversive agent may comprise a pungent agent. Pungent agents provide pungency, which is the characteristic commonly referred to as spiciness, hotness, or "heat," often found in foods such as chili peppers.

Non-limiting examples of suitable pungent agents may include: capsicinoids (including capsaicin); vanillyl ethyl ether; vanillyl propyl ether; vanillyl butyl ether; vanillin propylene; glycol acetal; ethylvanillin propylene glycol acetal; capsaicin; gingerol; 4-(1-menthoxymethyl)-2-(3'-methoxy-4'-hydroxy-phenyl)-1,3-dioxolane; pepper oil; pepper oleoresin; ginger oleoresin; nonylic acid vanillylamide; jamboo oleoresin; *Zanthoxylum piperitum* peel extract; sanshool; sanshoamide; black pepper extract; chavicine; piperine; spilanthol; and mixtures thereof. Other suitable pungent agents include polygodial, *Tasmannia lanceolata* extract, Capsicum extracts, or mixtures thereof. The pungent agent may comprise a capsaicinoid, for example capsaicin, dihydrocapsaicin, nordihydrocapsaicin, homodihydrocapsaicin, homocapsaicin, and/or nonivamide. The pungent agent may comprise capsaicin.

Commercially available suitable pungent agents include OPTAHEAT (Symise Flavors), HOTACT (Lipo Chemicals), and HEATENOL (Sensient Flavors).

The pungency of a pungent agent may be determined according to the well-known Scoville Scale and may be reported in Scoville heat units (SHU). The pungent agent may be selected from pungent agents having a pungency level of at least about 1,000,000 SHU, or at least about 5,000,000 SHU, or at least about 10,000,000 SHU, or at least about 15,000,000 SHU. For comparison, the pungency level of capsaicin is about 16,000,000 SHU. Pungency may also be measured by high performance liquid chromatography and determined in American Spice Trade Association (ASTA) pungency units. A measurement of one part capsaicin per million corresponds to about 15 Scoville units, and ASTA pungency units can be multiplied by 15 and reported as Scoville units.

The aversive agent may comprise an emetic agent. There are two main types of emetic agents: 1) those that work directly on the gastrointestinal tract of humans and animals, and 2) those that work indirectly by stimulating the areas of the brain that control vomiting.

Non-limiting examples of suitable emetic agents that work directly on the gastrointestinal tracts are selected from the group consisting of: ipecac (ipecac syrup and/or ipecac powder) obtained from *Cephaelis ipecacuanha*, lobelia obtained from *Lobelia inflata*, mustard seed obtained from *Brassica juncea*, vomitoxin obtained from *Fusarium graminearum*, copper sulfate, and mixtures thereof. The aversive agent may comprise ipecac.

An example of an emetic agent that works indirectly by stimulating the areas of the brain that control vomiting is apomorphine (apomorphine hydrochloride).

Water-Soluble Film

The film of the present invention is soluble or dispersible in water.

The water-soluble film preferably has a thickness of from 20 to 200 microns, preferably 35 to 150 microns, even more preferably 50 to 125 microns, most preferably from 75 to 100 microns, or 76 microns, or 100 microns. Preferably, the water-soluble film prior to being made into a water-soluble unit dose article has a thickness between 20 μm and 200 μm, preferably between 35 μm and 150 μm, even more preferably between 50 μm and 125 μm, most preferably between 75 μm and 100 μm or 76 microns, or 100 microns. Herein we mean the thickness of the film before it has been subjected to any thermoforming, elastic strain or plasticization techniques such as thermoforming into a mould for example or stretching from general film handling.

Different film material and/or films of different thickness may be employed in making the compartments of the present invention. A benefit in selecting different films is that the resulting compartments may exhibit different solubility or release characteristics.

Preferred films exhibit good dissolution in cold water, meaning unheated distilled water. Preferably such films exhibit good dissolution at temperatures 24° C., even more preferably at 10° C. By good dissolution it is meant that the film exhibits water-solubility of at least 50%, preferably at least 75% or even at least 95%, as measured, by the method set out here after using a glass-filter with a maximum pore size of 20 microns, described below. Water-solubility may be determined at 24° C., or preferably at 10° C.

Dissolution Method: 50 grams±0.1 gram of film material is added in a pre-weighed 400 ml beaker and 245 ml±1 ml of distilled water is added. This is stirred vigorously on a magnetic stirrer, labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion, or blown extrusion of the polymeric material, as known in the art. Preferably the film is obtained by an extrusion process or by a casting process.

Preferred polymers (including copolymers, terpolymers, or derivatives thereof) suitable for use as film material are selected from polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the polymers of the film material are free of carboxylate groups.

Preferably, the level of polymer in the film material, for example a PVA polymer, is at least 60%. The polymer can have any weight average molecular weight, preferably from about 1000 to 1,000,000, more preferably from about 10,000 to 300,000, yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000 to about 40,000, preferably about 20,000, and of PVA or copolymer thereof, with a weight average molecular weight of about 100,000 to about 300,000, preferably about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers, preferably polyvinyl alcohol, which are from about 60% to about 99% hydrolysed, preferably from about 80% to about 99% hydrolysed, even more preferably from about 80% to about 90% hydrolysed, to improve the dissolution characteristics of the material. Preferred films are those supplied by Monosol (Merrillville, Ind., USA) under the trade references M8630, M8900, M8779, M8310, M9467, and PVA films of corresponding solubility and deformability characteristics. Other suitable films may include called Solublon® PT, Solublon® GA, Solublon® KC or Solublon® KL from the Aicello Chemical Europe GmbH, the films VF-HP by Kuraray, or the films by Nippon Gohsei, such as Hi Selon. Suitable films include those supplied by Monosol for use in the following Procter and Gamble products: TIDE PODS, CASCADE ACTION PACS, CASCADE PLATINUM, CASCADE COMPLETE, ARIEL 3 IN 1 PODS, TIDE BOOST ORIGINAL DUO PACs, TIDE BOOST FEBREZE SPORT DUO PACS, TIDE BOOST VIVID WHITE BRIGHT PACS, DASH, FAIRY PLATINUM. It may be preferable to use a film that exhibits better dissolution than M8630 film, supplied by Monosol, at temperatures 24° C., even more preferably at 10° C.

Preferred water soluble films are those derived from a resin that comprises a blend of polymers, preferably wherein at least one polymer in the blend is polyvinyl alcohol. Preferably, the water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 centipoise (cP), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2: 2006 Annex E Brookfield Test method. It is international practice to state the viscosity of 4% aqueous polyvinyl alcohol solutions at 20° C. All viscosities specified herein in cP should be understood to refer to the viscosity of 4% aqueous polyvinyl alcohol solution at 20° C., unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons. Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

The films may be water soluble copolymer films comprising a least one negatively modified monomer with the following formula:

$$[Y]\text{-}[G]_n$$

wherein Y represents a vinyl alcohol monomer and G represents a monomer comprising an anionic group and the index n is an integer of from 1 to 3. G can be any suitable comonomer capable of carrying of carrying the anionic group, for example G is a carboxylic acid. G may be selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid, and mixtures thereof. Suitable films may include blends of such copolymers.

The anionic group of G may be preferably selected from the group consisting of $OSO_3M$, $SO_3M$, $CO_2M$, $OCO_2M$, $OPO_3M_2$, $OPO_3HM$ and $OPO_2M$. More preferably, the anionic group of G is selected from the group consisting of $OSO_3M$, $SO_3M$, $CO_2M$, and $OCO_2M$. Most preferably the anionic group of G is selected from the group consisting of $SO_3M$ and $CO_2M$. As used herein, M is a suitable counterion known to one of ordinary skill, such as hydrogen (H+), an alkali metal (e.g., $Na^+$, $K^+$), an alkali earth metal ($\frac{1}{2}Ca^{2+}$), or ammonium ($NH_4^+$).

The film material herein can also comprise one or more additive ingredients. For example, the film preferably comprises a plasticizing agent. The plasticizing agent may comprise water, glycerol, ethylene glycol, diethylene glycol, propylene glycol, diproypylene glycol, sorbitol, or mixtures thereof. In some aspects, the film comprises from about 2% to about 35%, or from about 5% to about 25%, by weight of the film, a plasticizing agent selected from group comprising water, glycerol, diethylene glycol, sorbitol, and mixtures thereof. In some aspects, the film material comprises at least two, or preferably at least three, plasticizing agents. In some aspects, the film is substantially free of ethanol, meaning that the film comprises from 0% (including 0%) to about 0.1% ethanol by weight of the film. In some aspects, the plasticizing agents are the same as solvents found in an encapsulated liquid composition.

Other additives may include water and functional detergent additives, including surfactant, to be delivered to the wash water, for example, organic polymeric dispersants, etc. Additionally, the film may comprise an aversive agent, further described herein.

The water-soluble unit dose article may comprise an area of print. The water-soluble unit dose article may be printed using flexographic techniques, ink jet printing techniques or a mixture thereof. The printed are may be on the film, preferably on the outside of the film, within the film, on the inside of the film or a mixture thereof. The printed area may convey information such as usage instructions, chemical safety instructions or a mixture thereof. Alternatively, the entire surface of the pouch, or substantially the entire surface of the pouch is printed in order to make the pouch opaque. The print may convey an image that reduces the risk of confusion and hence accidental ingestion of the pouch.

Detergent or Cleaning Composition

The water-soluble unit dose article comprises a detergent or cleaning composition. The detergent or cleaning composition may be a fabric detergent or cleaning composition, an automatic dishwashing detergent or cleaning composition or a mixture thereof.

By 'fabric detergent or cleaning composition' we herein mean compositions that provide cleaning benefit to fabrics, care benefit to fabrics or a mixture thereof.

The fabric detergent or cleaning composition may provide a cleaning benefit selected from stain removal, stain-repellency, anti-soil-redeposition, brightening, whitening dirt removal, malodour reduction or mixtures thereof.

The fabric detergent or cleaning composition may provide a care benefit selected from softening, freshness, anti-wrinkling, anti-colour fading, dye transfer inhibition, anti-static or mixtures thereof.

By 'automatic dishwashing detergent or cleaning composition' we herein mean automatic dishwashing compositions that provide cleaning benefits, care benefits or a mixture thereof. "Automatic dishwashing care benefits" refers to any automatic dishwashing composition that can provide shine, fast drying, metal, glass or plastic protection benefits.

The detergent or cleaning composition maybe in the form of a powder, a compacted powder, a liquid, or a mixture thereof.

By 'liquid' we herein mean any composition capable of wetting and treating a substrate and encompasses forms such as dispersions, gels, pastes and the like. A dispersion, for example, is a liquid comprising solid or particulate matter contained therein. The liquid composition may also include gases in suitably subdivided form.

The cleaning composition may comprise anionic surfactants, non-ionic surfactants, cationic surfactants, polyethylene glycol polymers, ethoxylated polyethyleneimines, rheology modifier, hueing dyes, perfumes, perfume microcapsules, chelants, enzymes, silicones, polyolefin waxes, latexes, oily sugar derivatives, cationic polysaccharides, polyurethanes, fatty acids, enzyme stabilizing systems; antioxidants, opacifier, pearlescent agent, deposition aid, builder, bleaching agent, bleach activator, bleach catalyst, organic shine polymers, surface modifying polymers, metal care agents, metal salts, anti-corrosion agents and mixtures thereof.

The detergent or cleaning composition may comprises from about 1% to 80% by weight of the detergent or cleaning composition of a surfactant. The surfactant may comprise anionic, nonionic, zwitterionic, ampholytic, zwitterionic, semi-polar, cationic surfactants or mixtures thereof. The surfactant may comprise anionic, nonionic, cationic surfactants and mixtures thereof.

The detergent or cleaning composition may comprise an enzyme. The enzyme may be selected from hemicellulases, peroxidases, proteases, cellulases, xylanases, lipases, phospholipases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidase, chondroitinase, laccase, and amylases, or mixtures thereof.

The detergent or cleaning composition may comprise a polymer. The polymer may be selected from carboxylate polymers, polyethylene glycol polymers, terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, ethoxylated polyethyleneimines and any combination thereof.

Other polymers include hydroxyethyl cellulose polymer. Preferably, the hydroxyethyl cellulose polymer is derivatised with trimethyl ammonium substituted epoxide. The cellulose polymer may have a molecular weight of between 100,000 and 800,000 daltons. The hydroxyethyl cellulose polymer may be added to the composition as a particle. It may be present in the composition of the particle or may be also be present as a liquid, or a mixture thereof.

The detergent or cleaning composition may comprise a rheology modifier. The rheology modifier can be selected from the group consisting of non-polymeric crystalline hydroxy-functional materials, polymeric rheology modifiers or mixtures thereof. Specific examples of suitable crystalline, hydroxyl-containing rheology modifiers include castor oil and its derivatives. Also practical are hydrogenated castor oil derivatives such as hydrogenated castor oil and hydrogenated castor wax.

The detergent or cleaning composition may comprise a builder. Suitable builders include polycarboxylate builders include cyclic compounds, particularly alicyclic compounds. Particularly suitable are citrate builders, e.g., citric acid and soluble salts thereof, particularly sodium salts thereof. The builder may be selected from aminocarboxylate builders, preferably selected from salts of MGDA (methylglycine-diacetic acid), GLDA (glutamic-N,N-diacetic acid), EDDS (ethylene diamine disuccinates) iminodisuccinic acid (IDS) and carboxymethyl inulin.

The detergent or cleaning composition may comprise a bleaching agent. Bleaching agents may comprise chlorine bleaches, oxygen bleaches, or mixtures thereof. Preferably, the bleach is selected from sodium perborate monohydrate, sodium perborate tetrahydrates, sodium percarbonate and mixtures thereof.

The detergent or cleaning composition may comprise a peroxyacid bleach precursors, preferably selected from precursors of perbenzoic acid, cationic peroxyacid precursors, peracetic acid, sodium acetoxybenzene sulfonate, pentaacetylglucose, sodium 3,5,5-trimethylhexanoyloxybenzene sulfonate (iso-NOBS), sodium nonanoyloxybenzene sulfonate (NOBS), amide substituted alkyl peroxyacid precursors, benzoxazin peroxyacid precursors and mixtures thereof. The bleach may comprise ε-phthalimidoperoxycaproic acid[phthaloiminoperoxyhexanoic acid (PAP).

Preferably, if the detergent or cleaning composition comprises an automatic dish washing composition, the automatic dishwashing composition is phosphate free, or substantially phosphate free.

The detergent or cleaning composition may comprise a hueing dye, a brightener or a mixture thereof.

Preferably the detergent or cleaning composition comprises a non-aqueous solvent, preferably between 5% and 30%, more preferably between 7% and 25% by weight of the detergent or cleaning composition of a non-aqueous solvent. Preferably, the non-aqueous solvent is selected from glycerol, ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal dipropylene glycol, polypropylene glycol, dipropylene glycol n-butyl ether, and mixtures thereof.

The detergent or cleaning composition may comprise water, preferably from 0.1% to 20%, more preferably from 0.5% to 15%, most preferably from 1% to 13.5% by weight of the detergent or cleaning composition of water.

Process for Making

The present invention is also to a process for making a water-soluble unit dose article according to the present invention comprising the steps of;

a. Preparing a water-soluble unit dose article;
b. Adding a particle according to the present invention to the unit dose article wherein the particle is applied by dusting, spraying, printing, electrostatic transfer and mixtures thereof.

The present invention is also a process for making a water-soluble unit dose article according to the present invention, comprising the steps of;

a. Adding a particle comprising an aversive agent to a water-soluble film wherein the particle is applied by dusting, spraying, printing, electrostatic transfer and mixtures thereof;
b. Preparing a water-soluble unit dose article comprising the film of part a.

The particles may be in the form of a powder composition or in the form of a slurry comprising the particles. The powder composition may be dusted onto the unit dose article of water-soluble film. The slurry may be sprayed, printed or coated onto the unit dose article or water-soluble film. If the particle is in the form of an encapsulate this may be present in a slurry or may simply be dusted onto the unit dose article or water-soluble film.

Suitable printing techniques include, flexographic printing, lithographic printing, gravure printing, ink jet printing, laser printing or mixtures thereof.

Method of Use

The present invention is also to a method of doing laundry comprising the steps of diluting a water-soluble unit dose article according to the present invention in water by a factor of at least 400 to form a wash liquor and then washing fabrics with said wash liquor.

The unit dose article of the present invention may be used alone in the wash operation or may be used in conjunction with other laundry additives such as fabric softeners or fabric stain removers. The unit dose article may be used in conjunction with fragrance boosting compositions such as commercially available 'Tenor Unstoppables'.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

Example 1

Unit dose articles as commercially available from UK supermarkets under the Ariel 3-in-1 Pods brand, and especially ones found in a packaged product as purchased from a UK supermarket on 21 May 2015 under the Ariel Pods 3in1 brand (barcode 4 015600 385392) were prepared. The water-soluble unit dose articles comprised within were three compartment unit dose articles and comprised a first and a second compartment arranged side by side in a 'ying yang' orientation, and were superposed onto a larger third compartment. All three compartments comprised a liquid composition. The third compartment comprised a green liquid, the first compartment comprised a blue compartment and the second compartment comprised a white compartment. The packaged product of the example 1 was a laundry detergent composition.

A first unit dose article may be dusted with an aversive agent wherein the aversive agent comprised particles wherein the particles comprised a carrier material and an aversive agent. In one example the aversive agent may be denatonium benzoate.

A second unit dose article may be sprayed with an aversive agent wherein the aversive agent comprised particles within a slurry wherein the may be denatonium benzoate.

A third unit dose article may be sprayed with an aversive agent wherein the aversive agent comprised encapsulates within a slurry wherein the encapsulates comprised a shell and an aversive agent within the core. In one example the aversive agent may be denatonium benzoate.

Example 2

Unit dose articles as commercially available from UK supermarkets under the Fairy Platinum All in One brand and especially ones found in a packaged product as purchased from a UK supermarket on 21 May 2015 under the Fairy Platinum All in One brand (barcode 5 410076 383825) were prepared. The outer container was a flexible opaque bag generally silver in colour and comprised the. The water-soluble unit dose articles comprised 4 compartments, wherein three smaller compartments were arranged on top of a larger fourth compartment. The fourth compartment comprised a powder composition and the first, second and third compartments comprised liquid compositions. The packaged product of example 2 was an automatic dishwashing composition.

A first unit dose article may be dusted with an aversive agent wherein the aversive agent comprised particles wherein the particles comprised a carrier material and an aversive agent. In one example the aversive agent may be denatonium benzoate.

A second unit dose article may be sprayed with an aversive agent wherein the aversive agent comprised particles within a slurry wherein the particles comprised a carrier material and an aversive agent. In one example the aversive agent may be denatonium benzoate.

A third unit dose article may be sprayed with an aversive agent wherein the aversive agent comprised encapsulates within a slurry wherein the encapsulates comprised a shell and an aversive agent within the core. In one example the aversive agent may be denatonium benzoate.

Example 3

Commercially available water-soluble films were prepared as follows;

a. A first film may be dusted with an aversive agent wherein the aversive agent comprised particles wherein the particles comprised a carrier material and an aversive agent;
b. A second film may be sprayed with an aversive agent wherein the aversive agent comprised particles within a slurry wherein the particles comprised a carrier material and an aversive agent;
c. A third film may be sprayed with an aversive agent wherein the aversive agent comprised encapsulates within a slurry wherein the encapsulates comprised a shell and an aversive agent within the core.

All three films may then formed into water-soluble unit dose articles.

Example 4

FIG. 1 shows a side-profile picture of a unit dose article (1) comprising a particle (2) on the outer surface wherein the particle comprises an aversive agent. The particle is distributed homogenously over the surface of the unit dose article (1).

Figure 2:
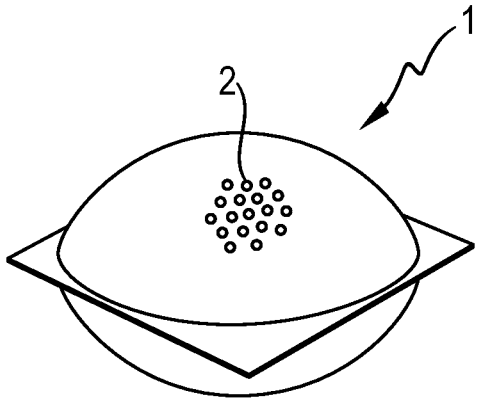
FIG. 2 shows a unit dose article comprising a particle wherein the particle is present in a discrete region only.

FIG. 2 shows a unit dose article (1) comprising a particle (2) wherein the particle is present in a discrete region only.

What is claimed is:

1. A water-soluble unit dose article comprising a detergent or cleaning composition, a water-soluble film, and a particle, wherein the water-soluble film surrounding the composition has an outer surface and wherein the particle is coated onto the outer surface of the water-soluble film, and wherein the particle comprises an aversive agent, and wherein the particle is in the form of: (1) a spray-dried particle, an agglomerate or an extrudate comprising a carrier material and the aversive agent; (2) an encapsulate comprising a shell and a core; (3) a particle comprising a carrier into which the aversive agent is absorbed or is coated onto the carrier; or 4) a mixture thereof; and wherein the water-soluble unit dose article comprises between about 5 $mg/m^2$ and about 500 $mg/m^2$ of the film outer surface of the particle.

2. The water-soluble unit dose article according to claim 1, wherein the particle comprises between about 10% and about 90% by weight of the particle of the aversive agent.

3. The water-soluble unit dose article according to claim 1 wherein the carrier is selected from the group consisting of carbonate, sulphate, zeolite, talc, clay, saccharides, polysaccharides and mixtures thereof.

4. The water-soluble unit dose article according to claim 3, wherein the carrier is polysaccharide.

5. The water-soluble unit dose article according to claim 4, wherein the polysaccharide is selected from maltodextrin, cellulose or a mixture thereof.

6. The water-soluble unit dose article according to claim 1 wherein the particle is in the form of a spray-dry particle, an agglomerate, an extrudate or a mixture thereof.

7. The water-soluble unit dose article according to claim 1, wherein the particle is in the form of an encapsulate, wherein the aversive agent is within the core, wherein the shell comprises polyvinyl alcohol, melamine formaldehyde, polylactide, polyglycolide, gelatin, polylactide, shellac, zein, chitosan, wax, hydrogenated vegetable oil, polysaccharides paraffin or mixtures thereof.

8. The water-soluble unit dose article according to claim 1, wherein the particle has an average particle size diameter of between about 10 microns and about 500 microns.

9. The water-soluble unit dose article according to claim 1, wherein the particles are arranged in one or more discrete regions of the outer surface of the film or are homogenously distributed across the outer surface of the film.

10. The water-soluble unit dose article according to claim 1 wherein the water-soluble unit dose article comprises between about 20 $mg/m^2$ and about 200 $mg/m^2$ of the film outer surface of the particle.

11. The water-soluble unit dose article according to claim 1 wherein the water-soluble film comprises polyvinyl alcohol.

12. The water-soluble unit dose article according to claim 1 wherein the film comprises at least one layer.

13. The water-soluble unit dose article according to claim 1 wherein the film comprises two layers, wherein the film is a laminate comprising at least two layers.

14. The water-soluble unit dose article according to claim 1 wherein the unit dose article further comprises aversive agent within the water-soluble film.

15. The water-soluble unit dose article according to claim 1, wherein the water-soluble film exhibits at least a about 50% aversive retention of at least about 2 weeks.

16. The water-soluble unit dose article according to claim 1 wherein the aversive agent is selected from the group consisting of naringin; sucrose octaacetate; denatonium benzoate; capsicinoids; vanillyl ethyl ether; vanillyl propyl ether; vanillyl butyl ether; vanillin propylene; glycol acetal; ethylvanillin propylene glycol acetal; capsaicin; gingerol; 4-(1-menthoxymethyl)-2-(3'-methoxy-4'-hydroxy-phenyl)-1,3-dioxolane; pepper oil; pepperoleoresin; gingeroleoresin; nonylic acid vanillylamide; jamboo oleoresin; *Zanthoxylum piperitum* peel extract; sanshool; sanshoamide; black pepper extract; chavicine; piperine; spilanthol; and mixtures thereof.

17. The water-soluble unit dose article according to claim 1 wherein the detergent or cleaning composition comprises anionic surfactants, non-ionic surfactants, cationic surfactants, polyethylene glycol polymers, ethoxylated polyethyleneimines, rheology modifier, hueing dyes, perfumes, perfume microcapsules, chelants, enzymes, silicones, polyolefin waxes, latexes, oily sugar derivatives, cationic polysaccharides, polyurethanes, fatty acids, enzyme stabilizing systems; antioxidants, opacifier, pearlescent agent, deposition aid, builder, bleaching agent, bleach activator, bleach catalyst, organic shine polymers, surface modifying polymers, metal care agents, metal salts, anti-corrosion agents or mixtures thereof.

18. The water-soluble unit dose article according to claim 1 wherein the unit dose article comprises at least two internal compartments.

19. A process for making a water-soluble unit dose article according to claim 1 comprising the steps of:

a. preparing a water-soluble unit dose article;

b. adding a particle comprising an aversive agent to the unit dose article wherein the particle is applied by dusting, spraying, printing, electrostatic transfer and mixtures thereof.

20. A process for making a water-soluble unit dose article according to claim 1 comprising the steps of:

a. adding a particle comprising an aversive agent to a water-soluble film wherein the particle is applied by dusting, spraying, printing, electrostatic transfer and mixtures thereof;

b. preparing a water-soluble unit dose article comprising the film of part a.

* * * * *